US009316959B2

(12) United States Patent
Miyauchi

(10) Patent No.: US 9,316,959 B2
(45) Date of Patent: Apr. 19, 2016

(54) FIXING DEVICE

(71) Applicant: Yoshihiro Miyauchi, Ama (JP)

(72) Inventor: Yoshihiro Miyauchi, Ama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/958,324

(22) Filed: Aug. 2, 2013

(65) Prior Publication Data

US 2013/0315640 A1 Nov. 28, 2013

Related U.S. Application Data

(63) Continuation of application No. 13/069,884, filed on Mar. 23, 2011, now Pat. No. 8,509,667.

(30) Foreign Application Priority Data

Aug. 31, 2010 (JP) ..... 2010-193329

(51) Int. Cl.
*G03G 15/20* (2006.01)

(52) U.S. Cl.
CPC ..... *G03G 15/2007* (2013.01); *G03G 15/2064* (2013.01); *G03G 2215/2035* (2013.01)

(58) Field of Classification Search
CPC ..... G03G 15/2007; G03G 15/2064; G03G 2215/2035
USPC ..... 399/33, 67, 69, 122, 328, 329
See application file for complete search history.

(56) References Cited

U.S. PATENT DOCUMENTS 8,160,484 B2 4/2012 Hasegawa et al.
8,428,498 B2 4/2013 Fujiwara et al.
8,509,667 B2 * 8/2013 Miyauchi ..... 399/329

(Continued)

FOREIGN PATENT DOCUMENTS

CN 101515152 A 8/2009
JP 2004-163464 A 6/2004

(Continued)

OTHER PUBLICATIONS

CN Office Action mailed Nov. 1, 2013, CN Appln. 201110082127.9, English translation.

(Continued)

*Primary Examiner* — David Gray
*Assistant Examiner* — Thomas Giampaolo, II
(74) *Attorney, Agent, or Firm* — Banner & Witcoff, Ltd.

(57) ABSTRACT

A fixing device includes: a fusing member; a heater; a nip member; a reflection member; a stay; and a backup member. The fusing member has an inner peripheral surface defining an internal space and is circularly movable. The inner peripheral surface is in sliding contact with the nip member. The reflection member reflects a radiant heat from the heater toward the nip member. The reflection member includes a reflection portion and an extending portion. The stay covers the reflection portion and supports the nip member. The extending portion extends outside of the stay. The backup member provides a nip region in cooperation with the nip member upon nipping the tubular flexible fusing member between the backup member and the nip member. The extending portion extends between the nip member and the stay. The extending portion is positioned exclusively downstream of the reflection portion in a sheet feeding direction.

42 Claims, 7 Drawing Sheets

(56) References Cited

U.S. PATENT DOCUMENTS

| | | | | |
|---|---|---|---|---|
| 2003/0160039 | A1 | 8/2003 | Eskey | |
| 2008/0317527 | A1 * | 12/2008 | Seol et al. | 399/331 |
| 2009/0208264 | A1 | 8/2009 | Fujiwara et al. | |
| 2010/0092220 | A1 | 4/2010 | Hasegawa et al. | |
| 2010/0158587 | A1 | 6/2010 | Shin | |
| 2012/0008971 | A1 | 1/2012 | Lee et al. | |

FOREIGN PATENT DOCUMENTS

| | | | |
|---|---|---|---|
| JP | 2006-047769 | A | 2/2006 |
| JP | 2008-233886 | A | 10/2008 |
| JP | 2010-096782 | A | 4/2010 |
| JP | 2010-113200 | A | 5/2010 |
| JP | 2010-156794 | A | 7/2010 |

OTHER PUBLICATIONS

JP Office Action dtd Jun. 19, 2012, JP Appln. 2010-193329, English translation.

Machine translation and corresponding drawings of JP 2004-163464, Inui, Jun. 10, 2004.

* cited by examiner

FIXING DEVICE

CROSS REFERENCE TO RELATED APPLICATION

This application is a continuation of U.S. application Ser. No. 13/069,884, filed Mar. 23, 2011, which claims priority from Japanese Patent Application No. 2010-193329 filed Aug. 31, 2010. The entire contents of the above-noted applications are incorporated herein by reference.

TECHNICAL FIELD

The present invention relates to a fixing device that thermally fixes a transferred developing agent image to a sheet.

BACKGROUND

A thermal fixing device for an electro-photographic type image forming device including a tubular fusing film, a heater disposed at a space defined in an inner peripheral surface of the fusing film, a pressure roller, and a nip plate defining a nip region in cooperation with the pressure roller through the fusing film, and a stay supporting the nip plate is known. Further, the fixing device includes a reflection plate disposed at a rear side of the heater to reflect radiant heat from the heater to the nip plate. In the fixing device with this configuration, the nip plate can be efficiently heated by the radiant heat from the heater.

SUMMARY

However, in such a fixing device, the reflection plate is disposed inside of the stay. Further, the reflection plate is not in contact with other components. Hence, the radiant heat from the heater is accumulated in the reflection plate, thereby raising a temperature of the reflection plate. Due to rise of the temperature, degradation and deformation of the reflection plate may occur. In view of the foregoing, it is an object of the present invention to provide a fixing device having a reflection plate capable of releasing heat accumulated therein outside of a stay.

In order to attain the above and other objects, the present invention provides a fixing device configured to thermally fix a developing agent image to a sheet fed in a sheet feeding direction including: a tubular flexible fusing member; a heater; a nip member; a reflection member; a stay; and a backup member. The tubular flexible fusing member has an inner peripheral surface defining an internal space and is configured to be circularly movable. The heater is disposed in the internal space and configured to radiate a radiant heat. The nip member is disposed in the internal space. The inner peripheral surface is configured to be in sliding contact with the nip member. The reflection member is configured to reflect the radiant heat from the heater toward the nip member. The reflection member includes a reflection portion and an extending portion. The stay is configured to cover the reflection portion and to support the nip member. The extending portion extends outside of the stay. The backup member is configured to provide a nip region in cooperation with the nip member upon nipping the tubular flexible fusing member between the backup member and the nip member. The extending portion extends between the nip member and the stay. The extending portion is positioned exclusively downstream of the reflection portion in the sheet feeding direction.

DETAILED DESCRIPTION

Figure 1:
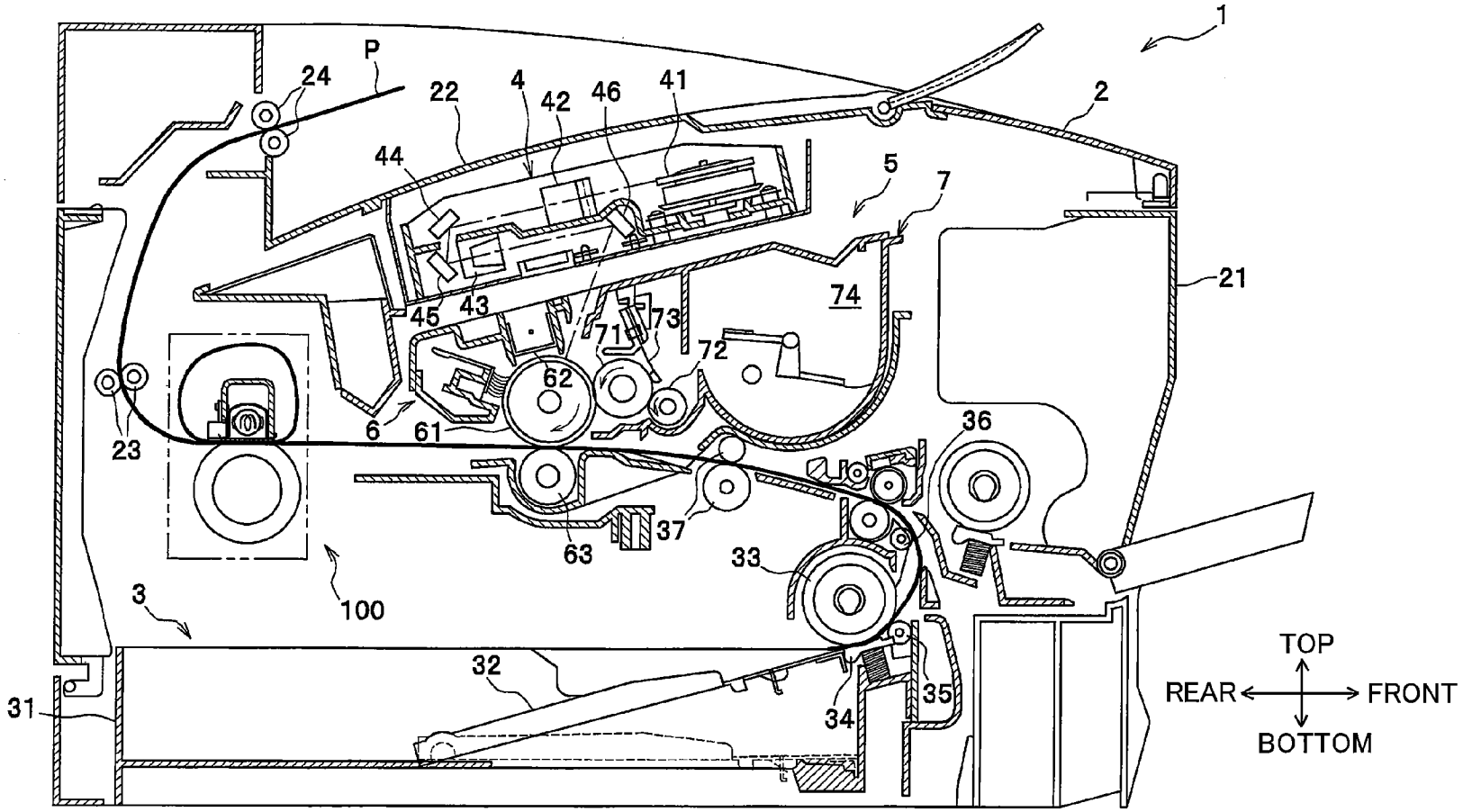
FIG. 1 is a schematic cross-sectional view showing a structure of a laser printer having a fixing device according to one embodiment of the present invention.

Next, a general structure of a laser printer as an image forming device according to one embodiment of the present invention will be described while referring to FIG. 1. The laser printer 1 shown in FIG. 1 is provided with a fixing device 100 according to the embodiment of the present invention. A detailed structure of the fixing device 100 will be described later while referring to FIGS. 2 to 5C.

<General Structure of Laser Printer>

As shown in FIG. 1, the laser printer 1 includes a main frame 2 with a movable front cover 21. Within the main frame 2, a sheet supply unit 3 for supplying a sheet P, an exposure unit 4, a process cartridge 5 for transferring a toner image (developing agent image) on the sheet P, and the fixing device 100 for thermally fixing the toner image onto the sheet P are provided.

Throughout the specification, the terms "above", "below", "right", "left", "front", "rear" and the like will be used assuming that the laser printer 1 is disposed in an orientation in which it is intended to be used. In use, the laser printer 1 is disposed as shown in FIG. 1. More specifically, in FIG. 1, a left side and a right side are a rear side and a front side, respectively.

The sheet supply unit 3 is disposed at a lower portion of the main frame 2. The sheet supply unit 3 includes a sheet supply tray 31 for accommodating the sheet P, a lifter plate 32 for lifting up a front side of the sheet P, a sheet supply roller 33, a sheet supply pad 34, paper dust removing rollers 35, 36, and registration rollers 37. Each sheet P accommodated in the sheet supply tray 31 is directed upward to the sheet supply roller 33 by the lifter plate 32, separated by the sheet supply roller 33 and the sheet supply pad 34, and conveyed toward the process cartridge 5 passing through the paper dust removing rollers 35, 36, and the registration rollers 37.

The exposure unit 4 is disposed at an upper portion of the main frame 2. The exposure unit 4 includes a laser emission unit (not shown), a rotationally driven polygon mirror 41, lenses 42, 43, and reflection mirrors 44, 45, 46. In the exposure unit 4, the laser emission unit is adapted to project a laser beam (indicated by a dotted line in FIG. 1) based on image data so that the laser beam is deflected by or passes through the polygon mirror 41, the lens 42, the reflection mirrors 44, 45, the lens 43, and the reflection mirror 46 in this order. A surface of a photosensitive drum 61 is subjected to high speed scan of the laser beam.

The process cartridge 5 is disposed below the exposure unit 4. The process cartridge 5 is detachable or attachable relative to the main frame 2 through a front opening defined by the front cover 21 at an open position. The process cartridge 5 includes a drum unit 6 and a developing unit 7.

The drum unit 6 includes the photosensitive drum 61, a charger 62, and a transfer roller 63. The developing unit 7 is detachably mounted to the drum unit 6. The developing unit 7 includes a developing roller 71, a toner supply roller 72, a regulation blade 73, and a toner accommodating portion 74 in which toner (developing agent) is accommodated.

In the process cartridge 5, after the surface of the photosensitive drum 61 has been uniformly charged by the charger 62, the surface is subjected to high speed scan of the laser beam from the exposure unit 4. An electrostatic latent image based on the image data is thereby formed on the surface of the photosensitive drum 61. The toner accommodated in the toner accommodating portion 74 is supplied to the developing roller 71 via the toner supply roller 72. The toner is conveyed between the developing roller 71 and the regulation blade 73 so as to be deposited on the developing roller 71 as a thin layer having a uniform thickness.

The toner deposited on the developing roller 71 is supplied to the electrostatic latent image formed on the photosensitive drum 61. Hence, a visible toner image corresponding to the electrostatic latent image is formed on the photosensitive drum 61. Then, the sheet P is conveyed between the photosensitive drum 61 and the transfer roller 63, so that the toner image formed on the photosensitive drum 61 is transferred onto the sheet P.

The fixing device 100 is disposed rearward of the process cartridge 5. The toner image (toner) transferred onto the sheet P is thermally fixed on the sheet P while the sheet P passes through the fixing device 100. The sheet P on which the toner image is thermally fixed is conveyed by conveying rollers 23 and 24 so as to be discharged on a discharge tray 22.

<Detailed Structure of Fixing Device>

Figure 2:
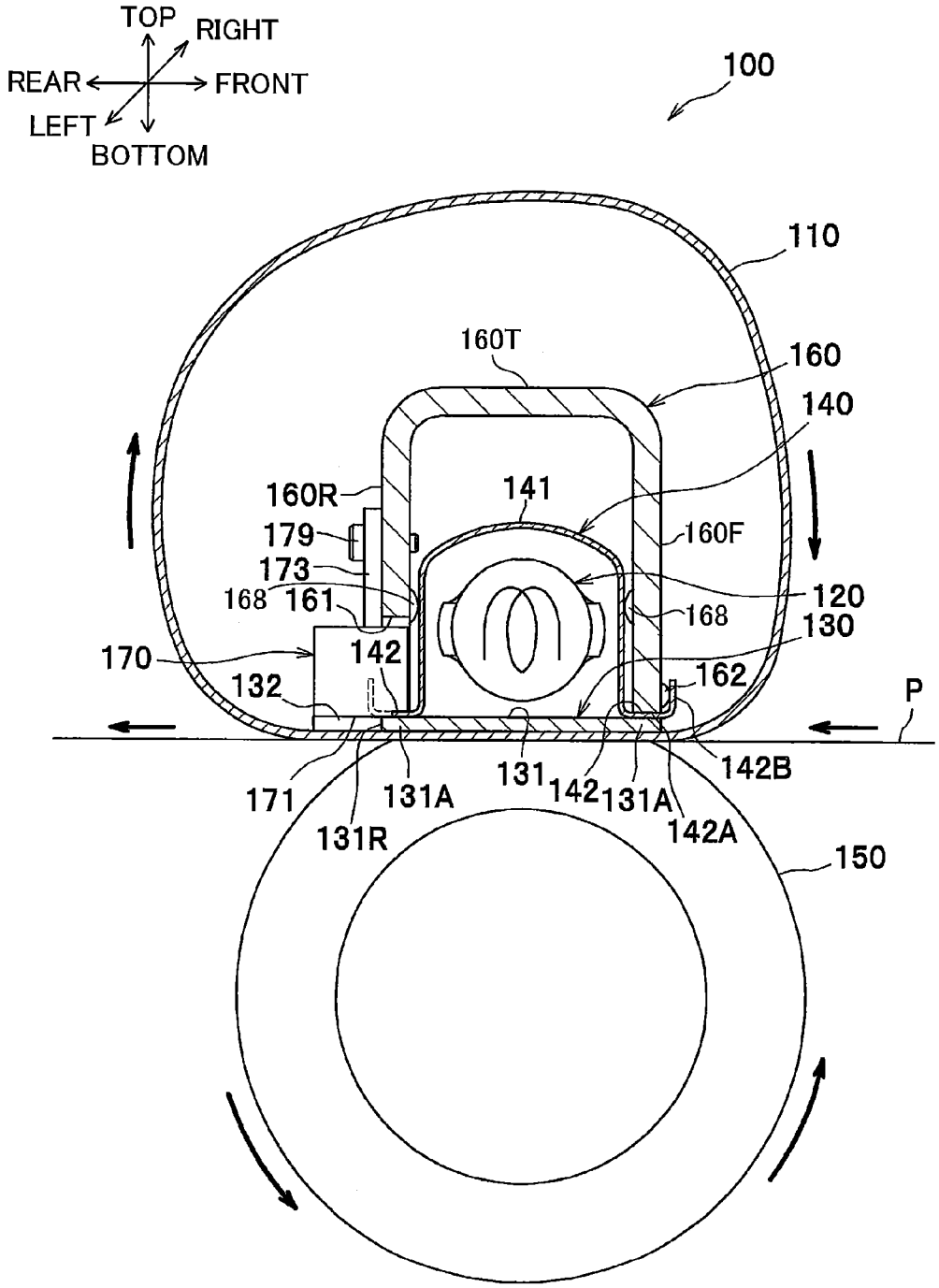
FIG. 2 is a schematic cross-sectional view of the fixing device according to the embodiment.
Figure 3:
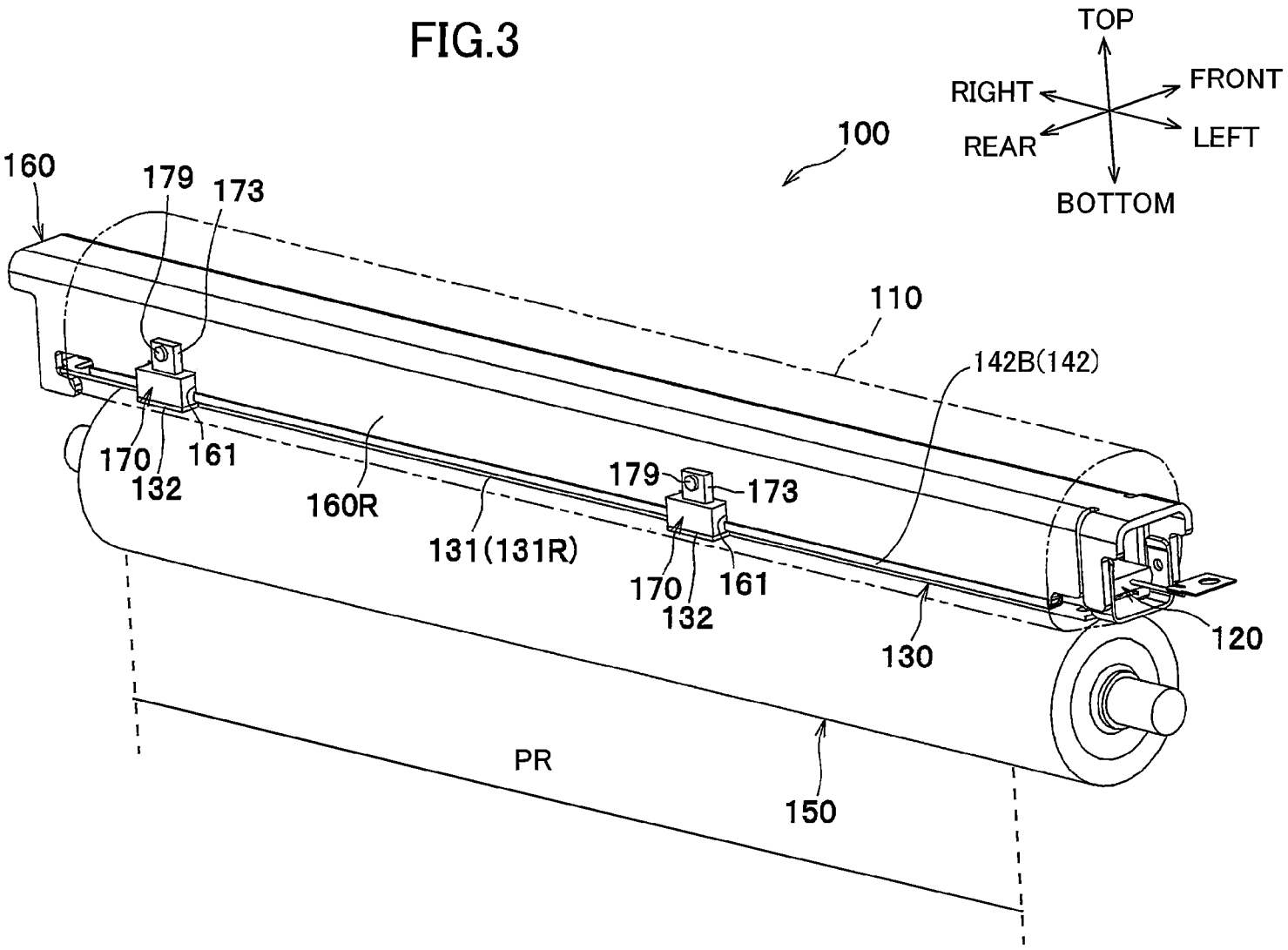
FIG. 3 is a perspective view of the fixing device according to the embodiment.

As shown in FIGS. 2 and 3, the fixing device 100 includes a flexible tubular fusing member such as a tube or film 110, a halogen lamp 120, a nip plate 130, a reflection plate 140 as a reflection member, a pressure roller 150 as a backup member, a stay 160, two thermistors 170, and a pair of guide members 180.

In the following description, a feeding direction of the sheet P or a frontward/rearward direction will be simply referred to as "sheet feeding direction", and a widthwise direction of the sheet P or a rightward/leftward direction will be simply referred to as "widthwise direction".

The fusing film 110 is of a tubular configuration having heat resistivity and flexibility. Each widthwise (left and right) end portion of the tubular film 110 is guided by the pair of guide members 180 fixed to a frame (not shown) of the fixing device 100 so that the fusing film 110 is circularly movable. The fusing film 110 has an inner peripheral surface being in sliding contact with the nip plate 130 via grease. The grease may be dispensed with, depending on materials of the fusing film 110 and of the nip plate 130.

The halogen lamp 120 is a heater to heat the nip plate 130 to heat the fusing film 110 for heating toner on the sheet P. The halogen lamp 120 is positioned at an internal space of the fusing film 110 and is spaced apart from the inner peripheral surface of the fusing film 110 as well as an inner (upper) surface of the nip plate 130 by a predetermined distance.

The nip plate 130 is adapted for receiving pressure from the pressure roller 150 and for transmitting radiation heat from the halogen lamp 120 to the toner on the sheet P through the fusing film 110. To this effect, the nip plate 130 is positioned in a stationary position such that the inner peripheral surface of the fusing film 110 moves slidably with a lower surface of the nip plate 130.

The nip plate 130 is made from a material such as aluminum having a thermal conductivity higher than that of the stay 160 (described later) made from steel. The nip plate 130 has a base portion 131 and two protruding portions 132.

Figure 4:
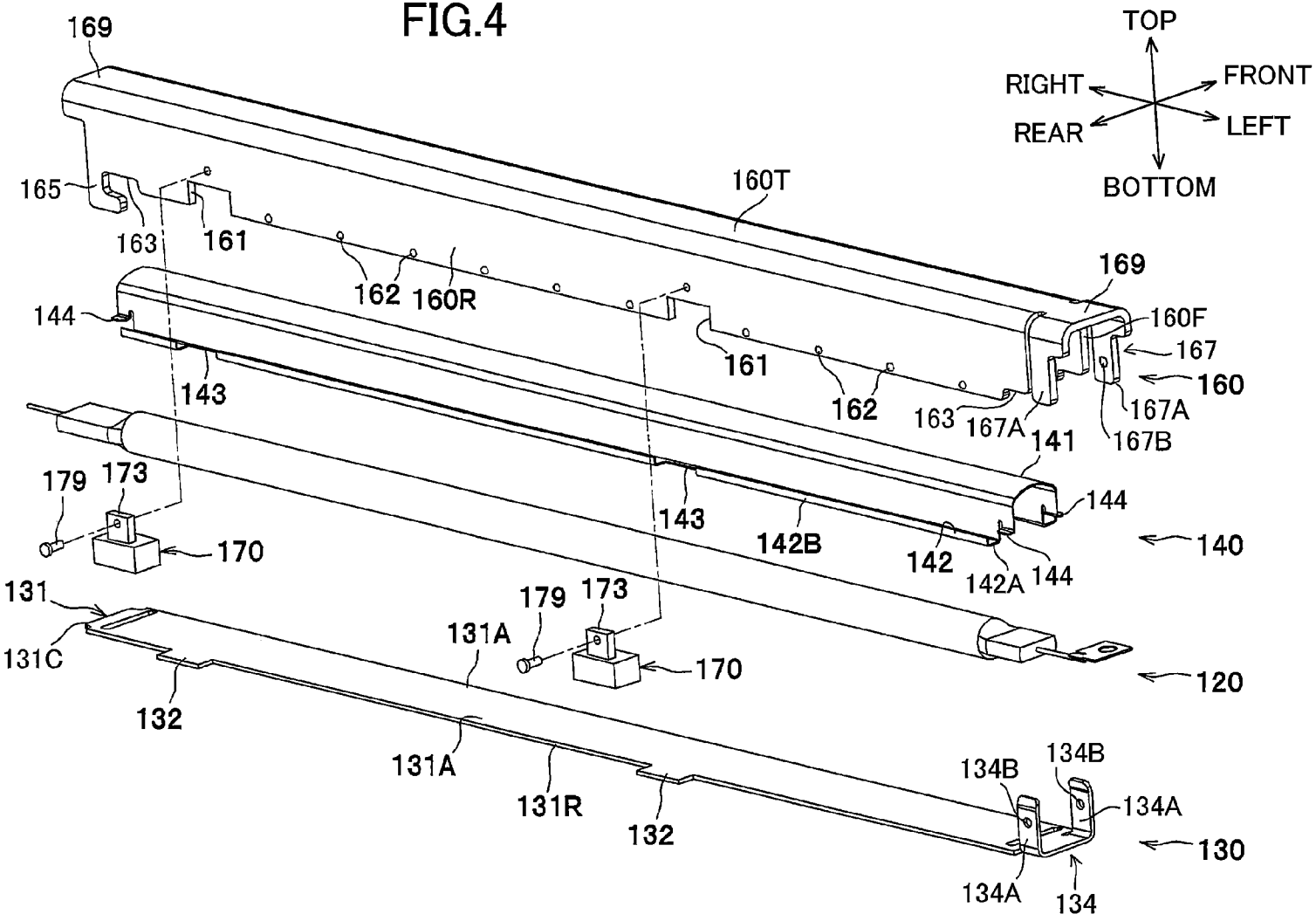
FIG. 4 is an exploded perspective view of the fixing device according to the embodiment, in which a halogen lamp, a nip plate, a reflection plate, a stay, and thermistors are shown.

As shown in FIG. 4, the base portion 131 extends flat in the widthwise direction. The base portion 131 has front and rear end portions 131A. The base portion 131 has an upper (inner) surface painted with a black color or provided with a heat absorbing member so as to efficiently absorb radiant heat from the halogen lamp 120.

The rear end portion 131A has a rear edge 131R from which two protruding portions 132 protrude rearward along the sheet feeding direction. As shown in FIG. 4, the protruding portions 132 are positioned at a right end portion and a center portion of the rear edge 131R in the widthwise direction, respectively.

As shown in FIG. 4, the nip plate 130 has a right end portion provided with an insertion portion 131C extending flat, and a left end portion provided with an engagement portion 134. The engagement portion 134 has U-shaped configuration as viewed from a left side including side wall portions 134A extending upward and formed with engagement holes 134B.

The reflection plate 140 is adapted to reflect radiant heat radiating from the halogen lamp 120 toward the nip plate 130 (toward the inner surface of the base portion 131). As shown in FIG. 2, the reflection plate 140 is positioned within the fusing film 110 and surrounds the halogen lamp 120, with a predetermined distance therefrom. Thus, radiant heat from the halogen lamp 120 can be efficiently concentrated onto the nip plate 130 to promptly heat the nip plate 130 and the fusing film 110.

The reflection plate 140 is configured into U-shape in cross-section and is made from a material such as aluminum having high reflection ratio regarding infrared ray and far infrared ray. The reflection plate 140 has a U-shaped reflection portion 141 and an extending portion 142 (extending member) extending outside of the stay 160 (described later) from each front and rear end portion of the reflection portion 141 in the sheet feeding direction. That is, one of the extending portions 142 is positioned upstream of the reflection portion 141 and remaining one of the extending portion 142 is positioned downstream of the reflection portion 141 in the sheet feeding direction.

The extending portion 142 has a fixed portion 142A extending along the nip plate 130 and a folding portion 142B extending from the fixed portion 142A. The fixed portion 142A is sandwiched between the nip plate 130 and the stay 160, and extends therebetween. The fixed portion 142A has a length in the sheet feeding direction so as to extend to outside of the stay 160 from inside thereof. The fixed portion 142A has an outer edge from which the folding portion 142B extends outward and then upward. That is, the folding portion 142B is folded at a substantially right angle relative to the fixed portion 142A. The folding portion 142B has an upper edge provided with a linear portion. As shown in FIG. 3, the extending portion 142 extends in the widthwise direction so as to have a widthwise length substantially the same as an entire widthwise length of a printing region PR of the sheet P.

Further, the rear extending portion 142 is formed with two notches 143 for positioning the two thermistors 170 at positions corresponding to the two protruding portions 132 of the nip plate 130. Further, each notch 143 is sized to provide a minute clearance from the thermistor 170 (to avoid contact with the thermistor 170).

A mirror surface finishing is available on the surface of the aluminum reflection plate 140 for specular reflection in order to enhance heat reflection ratio.

As shown in FIG. 4, two engagement sections 144 are provided at each widthwise end of the reflection plate 140. Each engagement section 144 is positioned higher than the extending portion 142.

As shown in FIG. 2, the pressure roller 150 is positioned below the nip plate 130 and nips the fusing film 110 in cooperation with the nip plate 130 to provide a nip region for nipping the sheet P between the pressure roller 150 and the fusing film 110. In other words, the pressure roller 150 presses the nip plate 130 through the fusing film 110 for providing the nip region between the pressure roller 150 and the fusing film 110.

The pressure roller 150 is rotationally driven by a drive motor (not shown) disposed in the main frame 2. By the rotation of the pressure roller 150, the fusing film 110 is circularly moved along the nip plate 130 because of the friction force generated therebetween or between the sheet P and the fusing film 110. A toner image on the sheet P can be thermally fixed thereto by heat and pressure during passage of the sheet P at the nip region between the pressure roller 150 and the fusing film 110.

The stay 160 is adapted to support the end portions 131A of the nip plate 130 (base portion 131) for maintaining rigidity of the nip plate 130. The stay 160 has a U-shape configuration having a front wall 160F, a rear wall 160R and a top wall 160T in conformity with the outer shape of the reflection portion 141 covering the reflection portion 141. For fabricating the stay 160, a highly rigid member such as a steel plate is folded into U-shape to have the front wall 160F, the rear wall 160R, and the top wall 160T.

As shown in FIG. 4, each of the front wall 160F and the rear wall 160R has a lower end portion 163.

As a result of assembly of the nip plate 130 together with the reflection plate 140 and the stay 160, the lower end portions 163 of the front wall 160F and the rear wall 160R are nipped between the right and left engagement sections 144. That is, the right engagement section 144 is in contact with the right lower end portion 163, and the left engagement section 144 is in contact with the left lower end portion 163. As a result, displacement of the reflection plate 140 in the widthwise direction due to vibration caused by operation of the fixing device 100 can be restrained by the engagement between the engagement sections 144 and the lower end portions 163.

The front and rear walls 160F, 160R have right end portions provided with L-shaped engagement legs 165 each extending downward and then leftward. The insertion portion 131C of the nip plate 130 is insertable into a space between the confronting engagement legs 165 and 165. Further, each end portion 131A of the base portion 131 is abuttable on each engagement leg 165 as a result of the insertion.

The top wall 160T has a left end portion provided with a retainer 167 having U-shaped configuration. The retainer 167 has a pair of retaining walls 167A whose inner surfaces are provided with engagement bosses 167B each being engageable with each engagement hole 134B.

Further, the top wall 160T has left and right end portions, each provided with a supported portion 169 protruding outward in the widthwise direction, as shown in FIG. 4. The supported portions 169 are supported to the guide members 180 described later.

As shown in FIGS. 2 and 4, each widthwise end portion of each of the front wall 160F and the rear wall 160R has an inner surface provided with two abutment bosses 168 protruding inward in abutment with front and rear side walls of the reflection portion 141 in the sheet feeding direction. Therefore, displacement of the reflection plate 140 in the sheet feeding direction due to vibration caused by operation of the fixing device 100 can be restrained because of the abutment of the reflection portion 141 with the bosses 168.

Each fixed portion 142A of the reflection plate 140 is sandwiched between the stay 160 and each end portion 131A of the nip plate 130. Thus, vertical displacement of the reflection plate 140 due to vibration caused by operation of the fixing device 100 can be restrained to fix the position of the reflection plate 140 relative to the nip plate 130 and to maintain rigidity of the reflection plate 140.

Each of the front wall 160F and the rear wall 160R has an outer surface provided with a plurality of projecting portions (contacting portions) 162 (shown in FIG. 4). The plurality of the projecting portions 162 are aligned in the widthwise direction. When the reflection plate 140 is assembled to the stay 160, the folding portions 142B are brought into contact with the front wall 160F and the rear wall 160R, respectively, via the projecting portions 162.

As shown in FIGS. 3 and 4, the rear wall 160R of the stay 160 is formed with two notches 161 for positioning the two thermistors 170 at positions in alignment with the two protruding portions 132. Further, each notch 161 is sized to provide a minute clearance from the thermistor 170 (to avoid contact with the thermistor 170).

A conventional temperature sensor is used as the thermistor 170 for detecting a temperature of the nip plate 130. More specifically, as shown in FIGS. 2 and 3, the two thermistors 170 are positioned within a space defined by the inner peripheral surface of the fusing film 110, and each thermistor 170 has an upper portion provided with a fixing rib 173 fixed to the rear wall 160R by a thread 179, and has a lower surface in direct confrontation with an upper surface of the protruding portion 132. The upper surface is a surface opposite to a surface in sliding contact with the fusing film 110. The lower surface serves as a temperature detection surface 171 in contact with the upper surface of the protruding portion 132. Each notch 143 prevents the thermistor 170 on the protruding portion 132 from directly seating on the extending portion 142.

Further, as shown in FIG. 2, each thermistor 170 is positioned outside of the reflection portion 141 of the reflection plate 140 in the sheet feeding direction. More specifically, each thermistor 170 is positioned outside of the nip region and downstream of (rear side of) the reflection plate 140 in the sheet feed direction. Further, each thermistor 170 is spaced away from the outer surface of the reflection portion 141 to avoid direct contact therewith.

A control unit (not shown) is provided in the main frame 2, and each thermistor 170 is connected to the control unit for transmitting a detection signal to the control unit. Thus, a fixing temperature at the nip region can be controlled by controlling an output of the halogen lamp 120 or by ON/OFF control to the halogen lamp 120 based on the signal indicative of the detected temperature. Such control is well known in the art.

When assembling the reflection plate 140 and the nip plate 130 to the stay 160 to which the thermistors 170 are fixed, first, the reflection plate 140 is temporarily assembled to the stay 160 by the abutment of the outer surface of the reflection portion 141 on the abutment bosses 168. In this case, the engagement sections 144 are in contact with the lower end portions 163.

Then, as shown in FIG. 3, the insertion portion 131C is inserted between the engagement legs 165 and 165, so that the base portion 131 can be brought into engagement with the engagement legs 165. Thereafter, the engagement bosses 167B are engaged with the engagement holes 134B. By this engagement, each extending portion 142 is sandwiched between the nip plate 130 and the stay 160. Thus, the nip plate 130 and the reflection plate 140 are held to the stay 160.

Figure 5A:
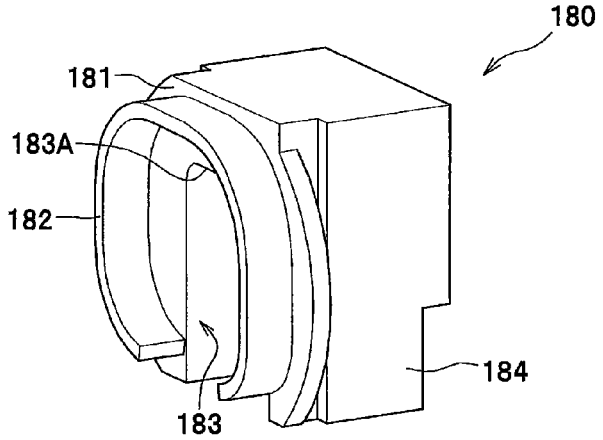
FIG. 5A is a perspective view of a guide member.

Further, the stay 160 holding the nip plate 130 and the reflection plate 140 are directly fixed to the pair of the guide members 180 shown in FIG. 5A. That is, the guide members 180 integrally hold the nip plate 130, the reflection plate 140, and the stay 160.

The guide member 180 is made from a thermally insulation material such as resin. Each of the guide members 180 is disposed at each of the widthwise end portions of the fusing film 110 for guiding circular movement of the fusing film 110. More specifically, each of the guide members 180 is provided to restrain movement of the fusing film 110 in the rightward/leftward direction (in an axial direction).

As shown in FIG. 5A, each of the guide members 180 includes a restricting surface 181 for restricting widthwise movement of the fusing film 110, a guide portion 182 for preventing the fusing film 110 from deforming radially inward, and a supporting recess 183 for supporting the front wall 160F and the rear wall 160R of the stay 160.

The guide portion 182 is a rib protruding inward from the restricting surface 181 in the rightward/leftward direction. The guide portion 182 has a generally C-shape having a bottom opening. The guide portion 182 is inserted into the tubular fusing film 110. That is, the guide portion 182 is in sliding contact with the inner peripheral surface of the fusing film 110 so as to restrain radially inward deformation of the fusing film 110. The guide portion 182 prevents the fusing film 110 from contacting the reflection plate 140, the stay 160, and the thermistors 170. The bottom opening of the guide portion 182 serves as a space for accommodating the stay 160 that is inserted into the supporting recess 183.

Figure 5B:
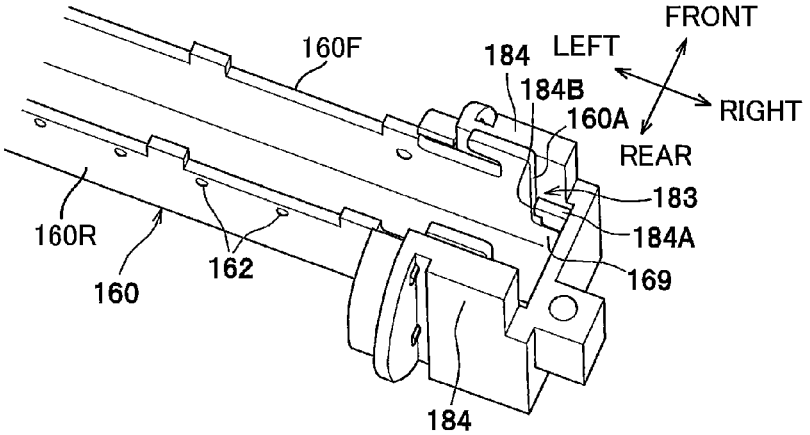
FIG. 5B is a perspective view of the guide member to which the stay is assembled as viewed from a bottom side thereof.
Figure 5C:
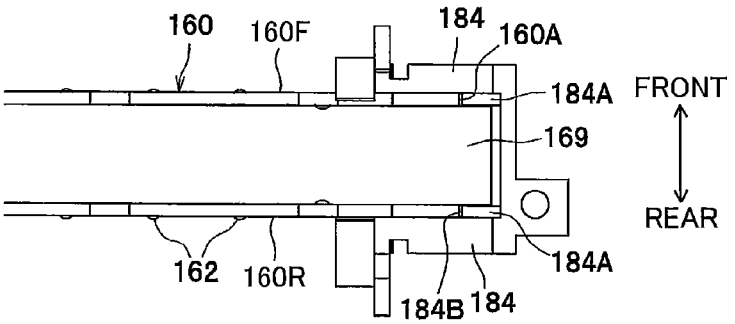
FIG. 5C is a bottom view of the guide member to which the stay is assembled.

The supporting recess 183 opens inward in the rightward/leftward direction and has a bottom opening. The supporting recess 183 has a top surface 183A (FIG. 5A). The guide member 180 has a pair of side walls 184 arranged in confrontation with each other in the frontward/rearward direction. The pair of the side walls 184 defines the supporting recess 183 therebetween. Each of the side walls 184 has a protruding portion 184A as shown in FIGS. 5B and 5C. The protruding portion 184A is formed so as to protrude inward from a portion spaced apart from the top surface 183A.

As shown in FIG. 5B, each of the supported portions 169 of the stay 160 is inserted into a space between the top surface 183A and the pair of the protruding portions 184A. Hence, vertical movement of the supported portion 169 can be regulated by the top surface 183A and the pair of the protruding portions 184A. As a result, vertical displacement of the stay 160 relative to the guide members 180 can be restrained.

Further, each of the protruding portions 184A has an inner surface 184B in the rightward/leftward direction. The stay 160 has a pair of outer edge portions 160A (FIG. 5B) in the rightward/leftward direction. Each of the outer edge portions 160A is brought into abutment with each of the inner surfaces 184B. With this configuration, displacement of the stay 160 relative to the guide members 180 in the rightward/leftward direction (widthwise direction) due to vibration caused by operation of the fixing device 100 can be restrained by abutment of the protruding portions 184A with the stay 160.

Further, displacement of the stay 160 in the frontward/rearward direction can be restrained, since the stay 160 is supported between the pair of the side walls 184. As described above, the stay 160 is supported to the guide members 180, so that the nip plate 130 and the reflection plate 140 are integrally supported to the guide members 180 via the stay 160.

The fixing device 100 according to the above-described embodiment provides the following advantages and effects: The reflection plate 140 is provided with the extending portion 142, and the extending portion 142 extends outside of the stay 160. Hence, even if the reflection plate 140 is heated by radiant heat from the halogen lamp 120, release of heat from the reflection plate 140 to outside of the stay 160 can be attained.

Further, the extending portion 142 extends between the nip plate 130 and the stay 160, and the fixed portion 142A is in contact with the nip plate 130 and the stay 160. Accordingly, heat from the reflection plate 140 can be transferred to the nip plate 130 and the stay 160 through the fixed portion 142A.

Further, one of the extending portions 142 is positioned upstream of the reflection portion 141 and remaining one of the extending portion 142 is positioned downstream of the reflection portion 141 in the sheet feeding direction. Compared to a case where the extending portion 142 is positioned either one of upstream or downstream of the reflection portion 141, the reflection plate 140 in the former case has an area for releasing heat therefrom greater than that of the reflection plate 140 in the latter case. Accordingly, temperature elevation of the reflection plate 140 can be easily controlled.

Further, the extending portion 142 is arranged so as to have the widthwise length substantially the same as the entire widthwise length of the printing region PR of the sheet P. Compared with a case where the extending portion 142 is arranged so as to have a widthwise length partly overlapping with the entire widthwise length of the printing region PR of the sheet P, prompt release of heat from the reflection plate 140 can be attained.

Further, the fusing film 110 is guided by the pair of guide members 180 so that the guide members 180 prevent the fusing film 110 from contacting the extending portions 142. Because the extending portions 142 are maintained to be spaced apart form the fusing film 110 by the guide members 180, that is, the extending portions 142 are not in contact with the fusing film 110, deprivation of heat from the fusing film 110 through the extending portions 142 can be prevented when the fixing device 100 starts to be heated.

The folding portions 142B are in contact with the projecting portions 162 provided at the outer surfaces of the front wall 160F and the rear wall 160R. Accordingly, through the projecting portions 162, heat from the reflection plate 140 can be transferred to the stay 160. Further, deformation of the reflection portion 141 by heat, which causes the extending portion 142 to move inward of the stay 160, can be prevented.

Various modifications are conceivable.

Figure 6:
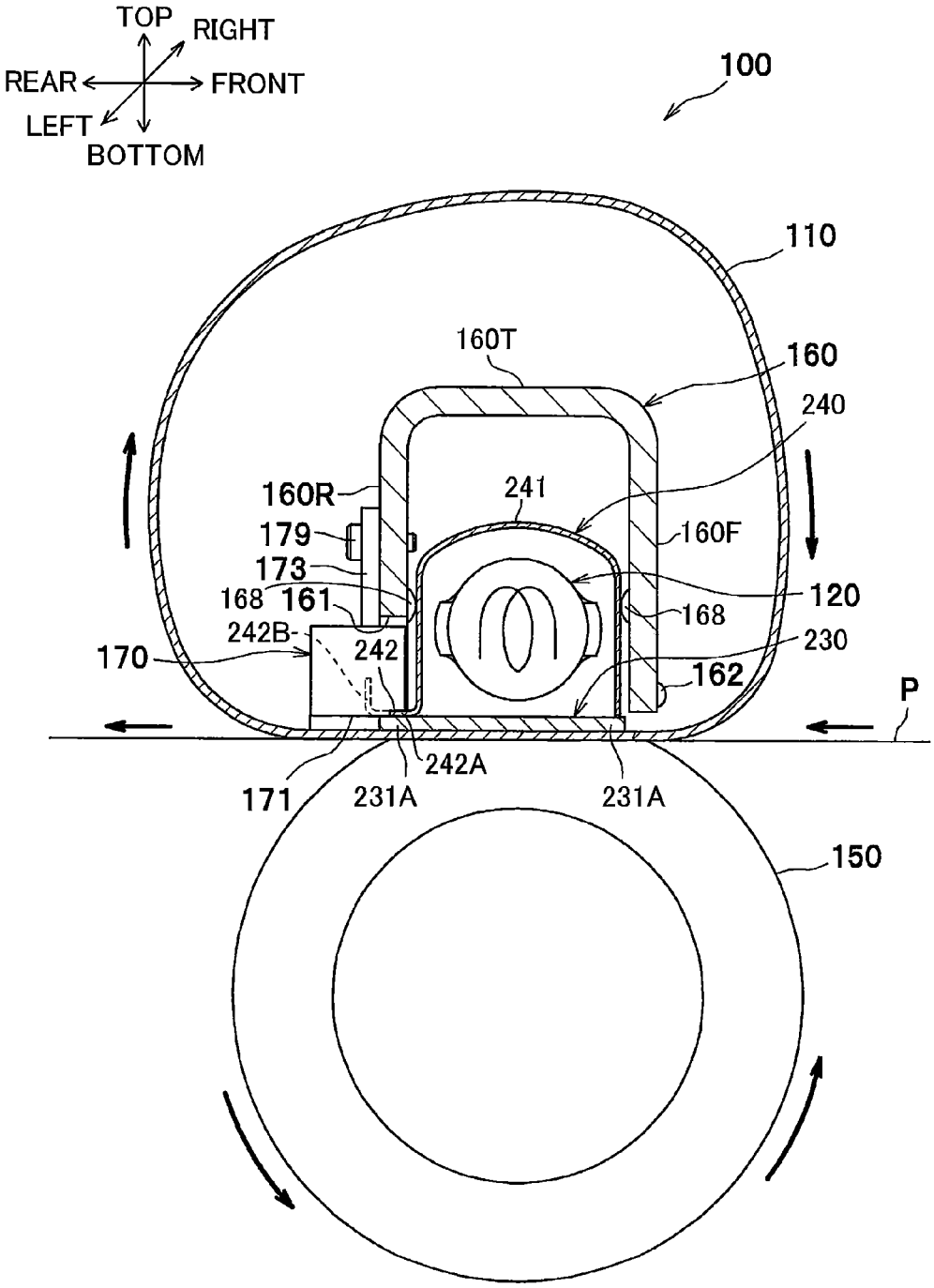
FIG. 6. is a schematic cross-sectional view of a fixing device according to a modification.

In the depicted embodiment, the extending portions 142 of the reflection plate 140 extend from the front and rear end portions of the reflection portion 141, respectively, so as to be positioned both upstream and downstream of the reflection portion 141 in the sheet feeding direction. However, for example, an extending portion 242 having a fixed portion 242A and a folding portion 242B may be positioned exclusively downstream of the reflection portion 241, as shown in FIG. 6. Without the extending portion 242 positioned upstream of the reflection portion 241, a structure for interposing the extending portion 242 between the front end portion 131A and the front wall 160F is not required. Thus, a length of the nip plate 230 in the sheet feeding direction can be reduced. Accordingly, the nip plate 230 can be downsized. As a result, the nip plate 230 can be promptly heated.

Figure 7:
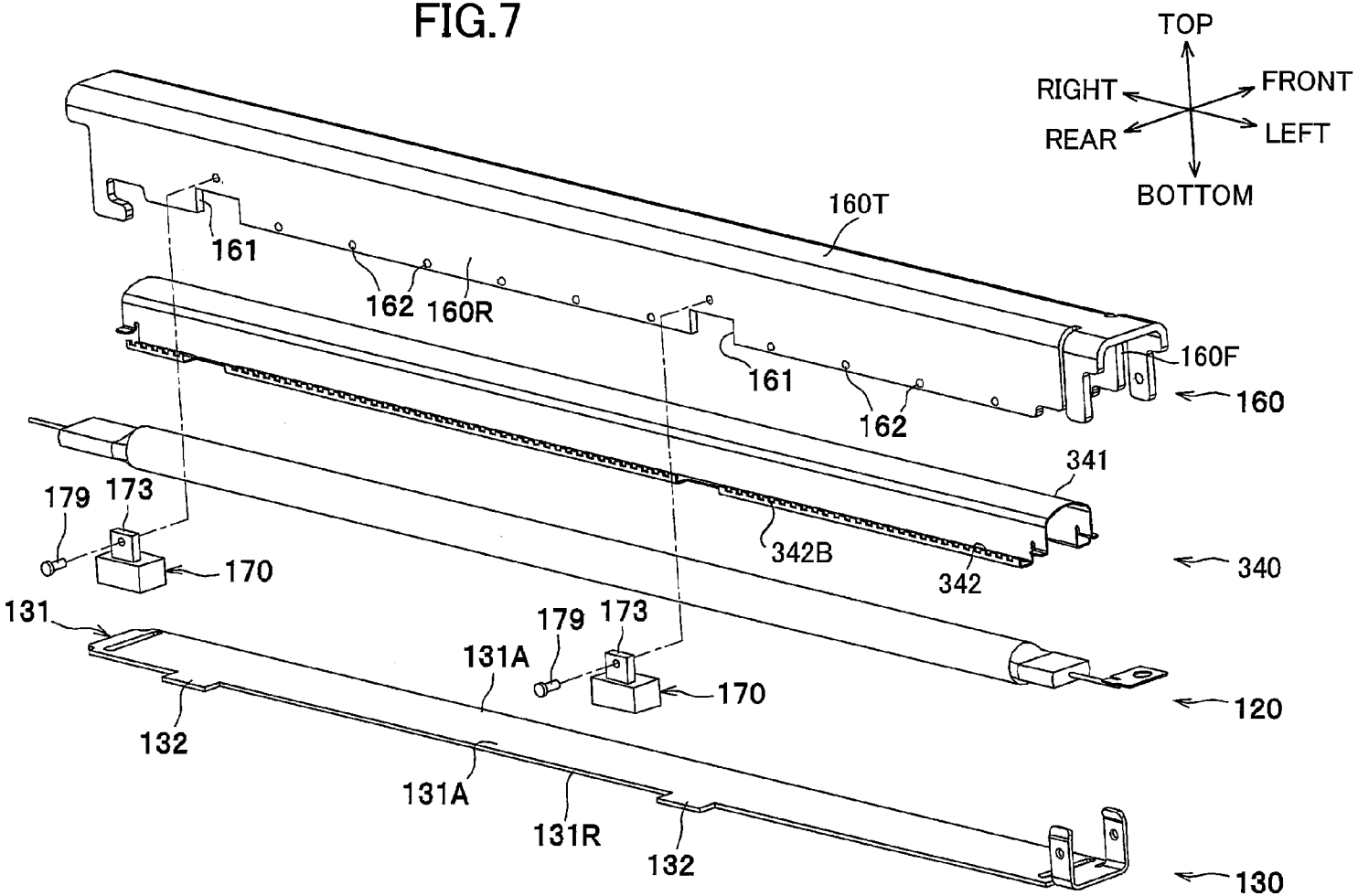
FIG. 7 is an exploded perspective view of a fixing device according to another modification, in which a halogen lamp, a nip plate, a reflection plate, a stay, and thermistors are shown.

In the depicted embodiment, the folding portion 142B of the extending portion 142 has a linear edge. However, as shown in FIG. 7, a reflection plate 340 may have a reflection portion 341 and extending portions 342, and the extending portion 342 may have a folding portion 342B with a comb-like edge. With this configuration, the folding portion 342B has a surface area greater than that of the folding portion 142B. Accordingly, release of heat from the reflection plate 340 can be efficiently attained.

In the depicted embodiment, the stay 160 is formed with the plurality of projecting portions 162, and the projecting portions 162 are brought into contact with the folding portion 142B of the extending portion 142. However, the projecting portions 162 may be dispensed with. Even if the folding portion 142B is not in contact with the stay 160, efficient release of heat from the reflection plate 140 can be attained by allowing the folding portion 142B to be exposed to external cooled air of the stay 160.

In the depicted embodiment, the fixing device 100 is provided in the monochromatic laser printer 1. However, for example, the fixing device 100 may be provided in a monochromatic copying machine, a monochromatic multifunction device, a color printer, a color copying machine, and a color multifunction device.

While the invention has been described in detail with reference to the embodiment thereof, it would be apparent to those skilled in the art that various changes and modifications may be made therein without departing from the spirit of the invention.

What is claimed is:

1. A fixing device comprising:

a tubular flexible fusing member;

a heater extending inside the tubular flexible fusing member;

a nip member contactable with an inner peripheral surface of the tubular flexible fusing member;

a roller rotatable about a rotational axis, the roller and the nip member configured to pinch the tubular flexible fusing member therebetween to define a nip region between the tubular flexible fusing member and the roller, the tubular flexible fusing member being rotatable in a rotational direction at the nip region;

a reflection member extending inside the tubular flexible fusing member; and a stay extending inside the tubular flexible fusing member, the stay comprising:

a first wall;

a second wall being disposed downstream relative to the first wall in the rotational direction; and a third wall connecting one end portion of the first wall and one end portion of the second wall, wherein the reflection member comprises:

a reflection portion recessed toward the third wall of the stay; and a first extending portion extending upstream in the rotational direction from an upstream end of the reflection portion in the rotational direction, the first extending portion further extending to a position upstream relative to the first wall of the stay in the rotational direction, the first extending portion further extending to a position upstream relative to an upstream edge of the nip member in the rotational direction, and the first extending portion including an upstream end portion in the rotational direction exposed to the inner peripheral surface of the tubular flexible fusing member.

2. The fixing device according to claim 1, wherein the heater is disposed between the nip member and the third wall of the stay.

3. The fixing device according to claim 1, wherein the reflection member further comprises a second extending portion extending downstream in the rotational direction from a downstream end of the reflection portion in the rotational direction, the second extending portion further extending to a position downstream relative to the second wall of the stay in the rotational direction, the second extending portion further extending to a position downstream relative to a downstream edge of the nip member in the rotational direction.

4. The fixing device according to claim 3, wherein at least a portion of the second extending portion is disposed inside, in a direction parallel to the rotational axis of the roller, a printing region of a sheet that is to pass through the nip region.

5. The fixing device according to claim 3, wherein at least a portion of the second extending portion is disposed inside the nip region in a direction parallel to the rotational axis of the roller.

6. The fixing device according to claim 3, wherein at least a portion of the second extending portion overlaps with a printing region of a sheet that is to pass through the fixing device, when viewed from a direction perpendicular to the rotational axis of the roller.

7. The fixing device according to claim 3, wherein at least a portion of the second extending portion overlaps with the nip region, when viewed from a direction perpendicular to the rotational axis of the roller.

8. The fixing device according to claim 3, wherein a length of the second extending portion in a direction parallel to the rotational axis of the roller is substantially equal to a length of a printing region of a sheet that is to pass through the nip region.

9. The fixing device according to claim 1, wherein the heater includes a halogen lamp.

10. The fixing device according to claim 1, wherein the tubular flexible fusing member includes a tubular film.

11. The fixing device according to claim 1, wherein the stay comprises a U-shape.

12. The fixing device according to claim 1, wherein the first extending portion has a notch.

13. The fixing device according to claim 1, wherein at least a portion of the first extending portion is disposed inside, in a direction parallel to the rotational axis of the roller, a printing region of a sheet that is to pass through the nip region.

14. The fixing device according to claim 1, wherein at least a portion of the first extending portion is disposed inside the nip region in a direction parallel to the rotational axis of the roller.

15. The fixing device according to claim 1, wherein at least a portion of the first extending portion overlaps with a printing region of a sheet that is to pass through the nip region when viewed from a direction perpendicular to the rotational axis of the roller.

16. The fixing device according to claim 1, wherein at least a portion of the first extending portion overlaps with the nip region, when viewed from a direction perpendicular to the rotational axis of the roller.

17. The fixing device according to claim 1, wherein a length of the first extending portion in a direction parallel to the rotational axis of the roller is substantially equal to a length of a printing region of a sheet that is to pass through the nip region.

18. The fixing device according to claim 1, wherein the first extending portion of the reflection member contacts the nip member.

19. The fixing device according to claim 1, wherein the heater is disposed between the reflection member and the nip member.

20. The fixing device according to claim 1, wherein the reflection member is configured to reflect radiant heat from the heater toward the nip member.

21. The fixing device according to claim 1, wherein the reflection portion of the reflection member is recessed away from the nip member.

22. A fixing device comprising:

a tube;

a heater extending inside an internal space of the tube;

a nip plate extending inside the internal space of the tube;

a backup member, the backup member and the nip plate configured to pinch the tube therebetween to define a nip region between the tube and the backup member, wherein a sheet is to be fed in a feeding direction at the nip region, a stay extending inside the internal space of the tube, the stay comprising:

a first wall;

a second wall disposed downstream relative to the first wall in the feeding direction; and a third wall connecting the first wall and the second wall; and a reflection plate extending inside the internal space of the tube, the reflection plate comprising:

a central portion recessed toward the third wall of the stay, and a first extending portion extending upstream in the feeding direction from an upstream end of the central portion in the feeding direction, wherein the first extending portion of the reflection plate further extends to a position upstream relative to the first wall of the stay in the feeding direction, and wherein the first extending portion of the reflection plate further extends to a position upstream relative to an upstream edge of the nip plate in the feeding direction.

23. The fixing device according to claim 22, wherein the reflection plate further comprises a second extending portion extending downstream in the feeding direction from a downstream end of the central portion in the feeding direction, the second extending portion further extending to a position downstream relative to the second wall of the stay in the feeding direction, the second extending portion further extending to a position downstream relative to a downstream edge of the nip plate in the feeding direction.

24. The fixing device according to claim 23, wherein at least a portion of the second extending portion is disposed inside, in a direction parallel to a longitudinal direction of the heater, a printing region of a sheet that is to pass through the nip region.

25. The fixing device according to claim 23, wherein at least a portion of the second extending portion is disposed inside the nip region in a direction parallel to a longitudinal direction of the heater.

26. The fixing device according to claim 23, wherein at least a portion of the second extending portion overlaps with a printing region of a sheet that is to pass through the nip region when viewed from a direction perpendicular to a longitudinal direction of the heater.

27. The fixing device according to claim 23, wherein at least a portion of the second extending portion overlaps with the nip region when viewed from a direction perpendicular to a longitudinal direction of the heater.

28. The fixing device according to claim 23, wherein a length of the second extending portion in a direction parallel to a longitudinal direction of the heater is substantially equal to a length of a printing region of a sheet that is to pass through the nip region.

29. The fixing device according to claim 22, wherein the heater is disposed between the nip plate and the third wall of the stay.

30. The fixing device according to claim 22, wherein the reflection plate has a portion disposed between the third wall of the stay and the heater.

31. The fixing device according to claim 22, wherein the heater comprises a halogen lamp.

32. The fixing device according to claim 22, wherein the tube comprises a tubular film.

33. The fixing device according to claim 22, wherein at least a portion of the first extending portion is disposed inside, in a direction parallel to a longitudinal direction of the heater, a printing region of a sheet that is to pass through the nip region.

34. The fixing device according to claim 22, wherein at least a portion of the first extending portion is disposed inside the nip region in a direction parallel to a longitudinal direction of the heater.

35. The fixing device according to claim 22, wherein at least a portion of the first extending portion overlaps with a printing region of a sheet that is to pass through the nip region when viewed from a direction perpendicular to a longitudinal direction of the heater.

36. The fixing device according to claim 22, wherein at least a portion of the first extending portion overlaps with the nip region when viewed from a direction perpendicular to a longitudinal direction of the heater.

37. The fixing device according to claim 22, wherein a length of the first extending portion in a direction parallel to a longitudinal direction of the heater is substantially equal to a length of a printing region of a sheet that is to pass through the nip region.

38. The fixing device according to claim 22, wherein the reflection plate is configured to reflect radiant heat from the heater toward the nip plate.

39. The fixing device according to claim 22, wherein the central portion of the reflection plate is recessed away from the nip plate.

40. A fixing device comprising:

a tube;

a halogen lamp extending inside an internal space of the tube;

a nip plate extending inside the internal space of the tube;

a backup member, the backup member and the nip plate configured to pinch the tube therebetween to define a nip region between the tube and the backup member, wherein a sheet is to be fed in a feeding direction at the nip region, a stay extending inside the internal space of the tube; and a reflection plate extending inside the internal space of the tube, the reflection plate comprising:

a reflection portion recessed toward the stay, and an extending portion extending in the feeding direction from a downstream end of the reflection portion in the feeding direction, wherein the stay has:

a first wall, and a second wall disposed downstream relative to the first wall in the feeding direction, wherein the extending portion of the reflection plate further extends to a position downstream relative to the second wall of the stay in the feeding direction, and wherein the extending portion of the reflection plate further extends to a position downstream relative to a downstream edge of the nip plate in the feeding direction.

41. The fixing device according to claim 40, wherein at least a portion of the extending portion is disposed inside, in a direction parallel to a longitudinal direction of the halogen lamp, a printing region of a sheet that is to pass through the nip region.

42. The fixing device according to claim 40, wherein the reflection portion of the reflection plate is recessed away from the nip plate.

* * * * *